US006182936B1

(12) United States Patent
Yang

(10) Patent No.: US 6,182,936 B1
(45) Date of Patent: Feb. 6, 2001

(54) COPY HOLDER

(76) Inventor: Li Fen Yang, No. 48, Don An Road, He Mei Chen, Chang Hua Hsien (TW)

( * ) Notice: Under 35 U.S.C. 154(b), the term of this patent shall be extended for 0 days.

(21) Appl. No.: 08/902,260

(22) Filed: Jul. 29, 1997

(51) Int. Cl.[7] ..... B41J 11/02
(52) U.S. Cl. ..... 248/442.2; 211/45; 248/316.3; 400/718
(58) Field of Search ..... 248/442.2, 451, 248/918, 316.3, 447.2; 400/718; 211/45

(56) References Cited

U.S. PATENT DOCUMENTS 3,591,013 * 7/1971 Vor Hermann ..... 211/50
4,085,848 * 4/1978 Tsuge ..... 211/45
5,152,490 * 10/1992 Deutsch ..... 248/452

* cited by examiner

*Primary Examiner*—Ramon O. Ramirez
(74) *Attorney, Agent, or Firm*—Rosenberg, Klein & Lee

(57) ABSTRACT

A copy holder including a flat holder base having at least one arched flange raised from a front side thereof near a top side thereof and defining a document insertion mouth, a first pair of vertically spaced lugs and a second pair of vertically spaced lugs bilaterally raised from a back side thereof; document clamping means mounted on the flat holder base and adapted to hold down inserted sheets of document in the document insertion mouth; an angle-adjustable mounting device pivoted to the first pair of vertical lugs of the holder base and adapted for securing to a monitor of a computer system for supporting the flat holder base; and a curved holding-down block pivoted to the second pair of vertically spaced lugs of the holder base and adapted to hold down turned-up sheets of document on the back side of the holder base.

6 Claims, 8 Drawing Sheets

1
2
3
4
4'
5
11
11'
12
14
15
21
22
31
32
33
41
41'
42
42'
211
212
213
221
222
231
2311
2321
2322
2121
411(41')
421
421'

COPY HOLDER

BACKGROUND OF THE INVENTION

The present invention relates to copy holders, and more particularly to a copy holder adapted for mounting on a monitor of a computer system to hold sheets of document that can be conveniently adjusted to the desired angle.

A variety of copy holders have been disclosed for holding sheets of document on a desk top or a monitor of a computer system, and have appeared on the market. However, these conventional copy holders still have drawbacks. When a conventional copy holder is fixed to a desk top or a monitor of a computer system, it can not be adjusted to the desired angle. Another drawback of conventional copy holders is that they do not have means to hold down turned-up sheets of document. Still another drawback of conventional copy holders is that the springs of the document clamping means start to wear quickly with use. When the springs of the document clamping means of a copy holder starts to wear, the document clamping means will be unable to hold down sheets of document firmly. Furthermore, when a copy holder is fixedly to a monitor of a computer system, it cannot be collapsed and closely attached to the periphery of the monitor.

SUMMARY OF THE INVENTION

The present invention has been accomplished to provide a copy holder which eliminates the aforesaid drawbacks. According to one aspect of the present invention, the copy holder comprises a flat holder base having at least one arched flange raised from a front side thereof near a top side thereof and defining a document insertion mouth, a first pair of vertically spaced lugs and a second pair of vertically spaced lugs bilaterally raised from a back side thereof; document clamping means mounted on the flat holder base and adapted to hold down inserted sheets of document in the document insertion mouth; an angle-adjustable mounting device pivoted to the first pair of vertical lugs of the holder base and adapted for securing to a monitor of a computer system for supporting the flat holder base; and a curved holding-down block pivoted to the second pair of vertically spaced lugs of the holder base and adapted to hold down turned-up sheets of document on the back side of the holder base. According to another aspect of the present invention, the at least one arched flange of the holder base defines with the front side of the holder base at least one roller chamber above the document insertion mouth, the at least one roller chamber having a width gradually upwardly increasing from the document insertion mouth; the document clamping means comprises at least one rack mounted in a respectively hole in the holder base corresponding to the at least one roller chamber, each of the at least one rack having a plurality of transverse teeth, and at least one toothed roller respectively turned in said at least one roller chamber, each of the at least one toothed roller having a plurality of longitudinal teeth equiangularly spaced around the periphery and adapted to engage the transverse tooth of the at least one rack. According to still another aspect of the present invention, the angle-adjustable mounting device comprises a mounting frame adapted for securing to a monitor of a computer system, a swivel support pivoted to the first pair of vertically spaced lugs of the holder base and revolvably supported on the mounting frame, and a spring strip mounted in a smoothed curved groove on the mounting frame and adapted to retain the swivel support in position.

DETAILED DESCRIPTION OF THE PREFERRED EMBODIMENTS

Figures 1, 1A, 1B:
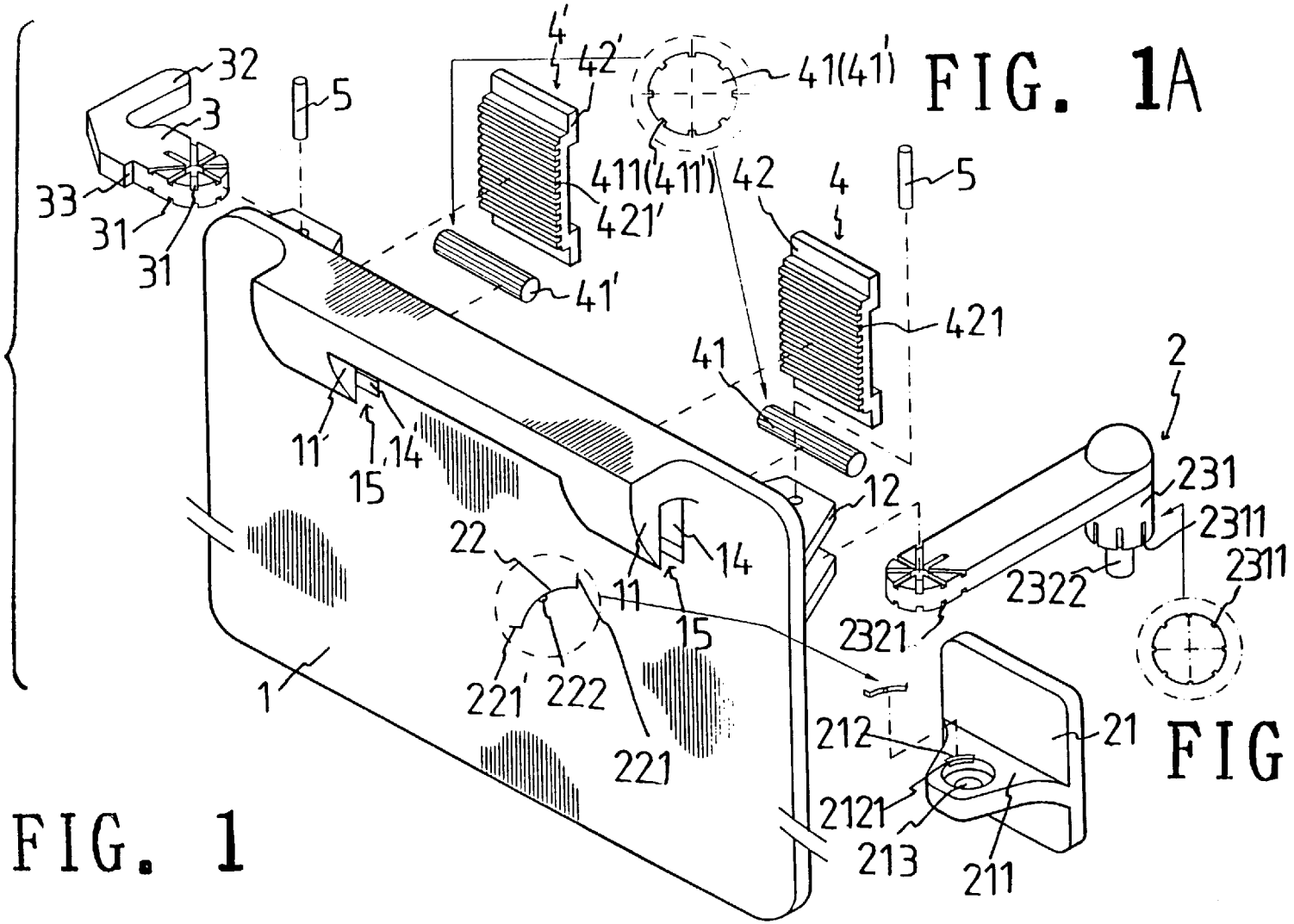
FIG. 1 is an exploded view of a copy holder according to one embodiment of the present invention.
FIG. 1A is a sectional view of the mounting shaft of the swivel support of the angle-adjustable mounting device according to the present invention.
FIG. 1B is a sectional view of the toothed roller according to the present invention.

Referring to FIG. 1, a copy holder in accordance with the present invention is generally comprised of a holder base 1, an angle adjustable mounting device 2, a curved holding-down block 3, and two clamping devices 4;4'.

Figure 3:
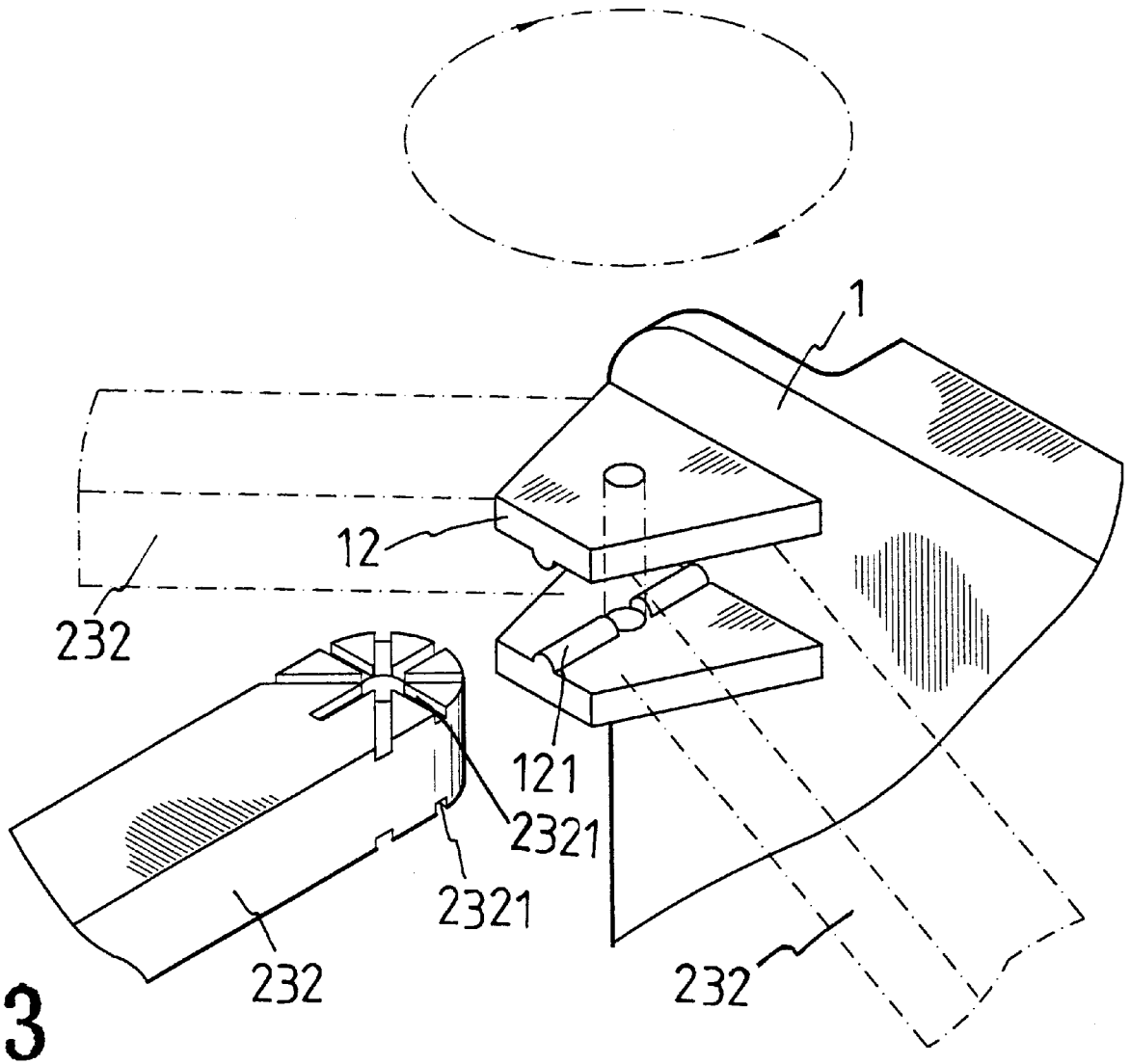
FIG. 3 is an enlarged view of a part of the present invention, showing the relationship between the swivel support of the angle-adjustable mounting device and the first pair of vertically spaced lugs of the holder base.
Figure 4:
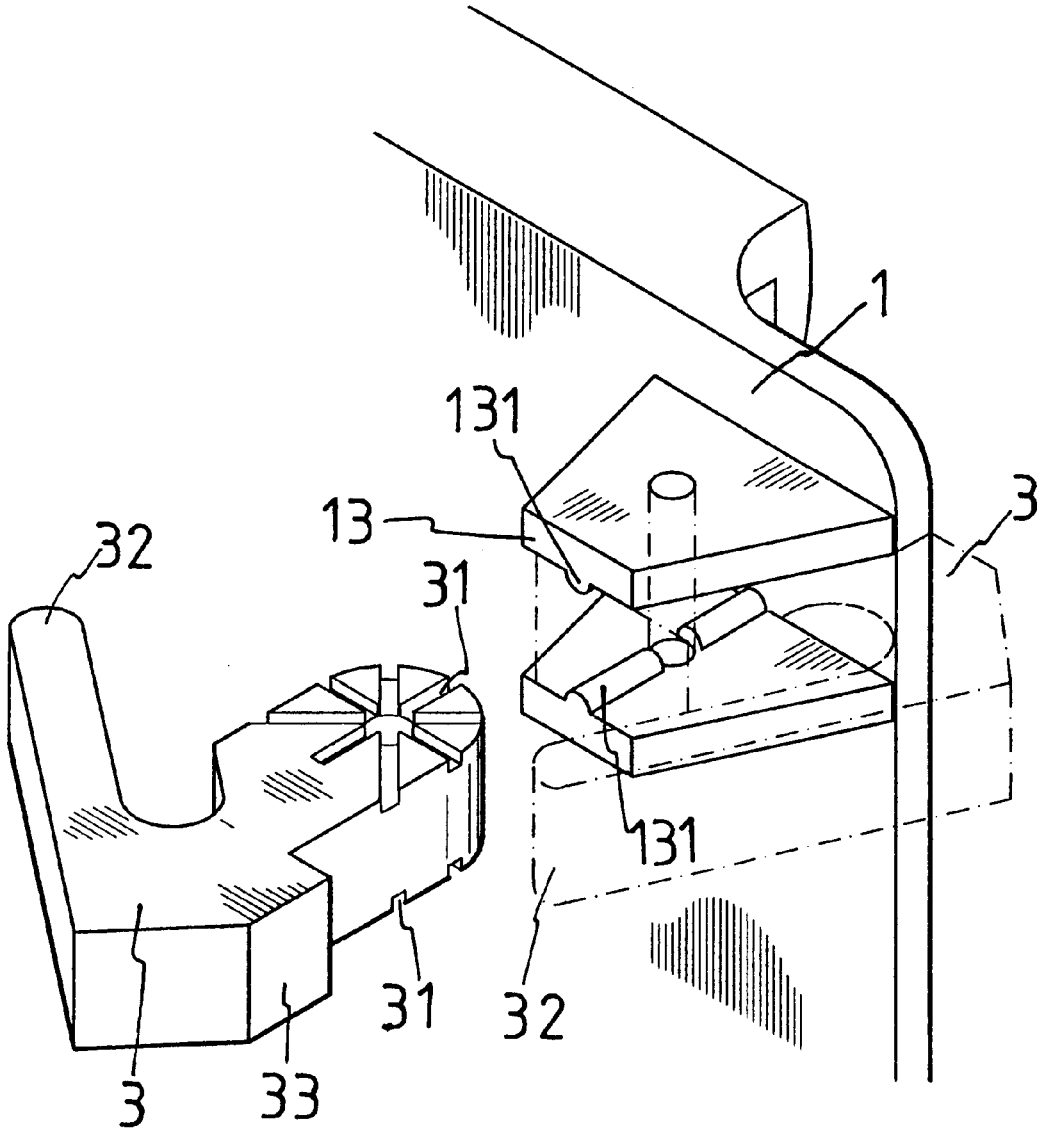
FIG. 4 is an enlarged view of a part of the present invention, showing the relationship between the curved holding-down block and the second pair of vertically spaced lugs of the holder base.
Figure 5:
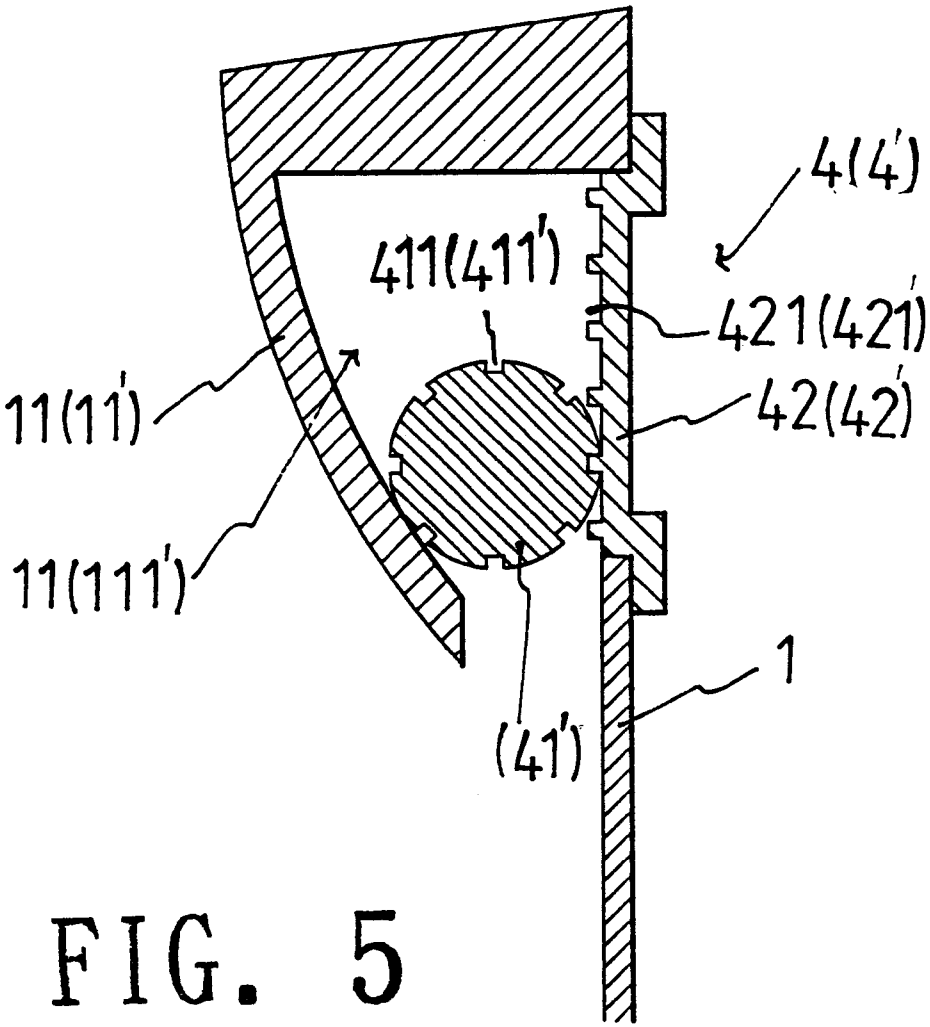
FIG. 5 is a sectional view in an enlarged scale of a part of the present invention, showing the clamping device installed in the holder base.

Referring to Figures from 3 to 5 and FIG. 1 again, the flat holder base 1 comprises two arched flanges 11;11' symmetrically raised from its front side at the top and defining a respective roller chamber 111;111' (see FIG. 5) and a mouth 15;15' in front of the respective roller chamber 111;111', a first pair of vertically spaced lugs 12 and a second pair of vertically spaced lugs 13 bilaterally raised from its back side at the top, and two mounting holes 14;14' respectively disposed in communication with the roller chambers 111;111'. The first pair of vertically spaced lugs 12 have a respective pivot hole 120, and a respective pair of ribs 121 raised from its inside wall and extended from the respective pivot hole 120 in reversed directions (see FIG. 3). The second pair of vertically spaced lugs 13 have a respective pivot hole 130, and a respective pair of ribs 131 raised from its inside wall and extended from the respective pivot hole 130 in reversed directions (see FIG. 4).

Figure 2:
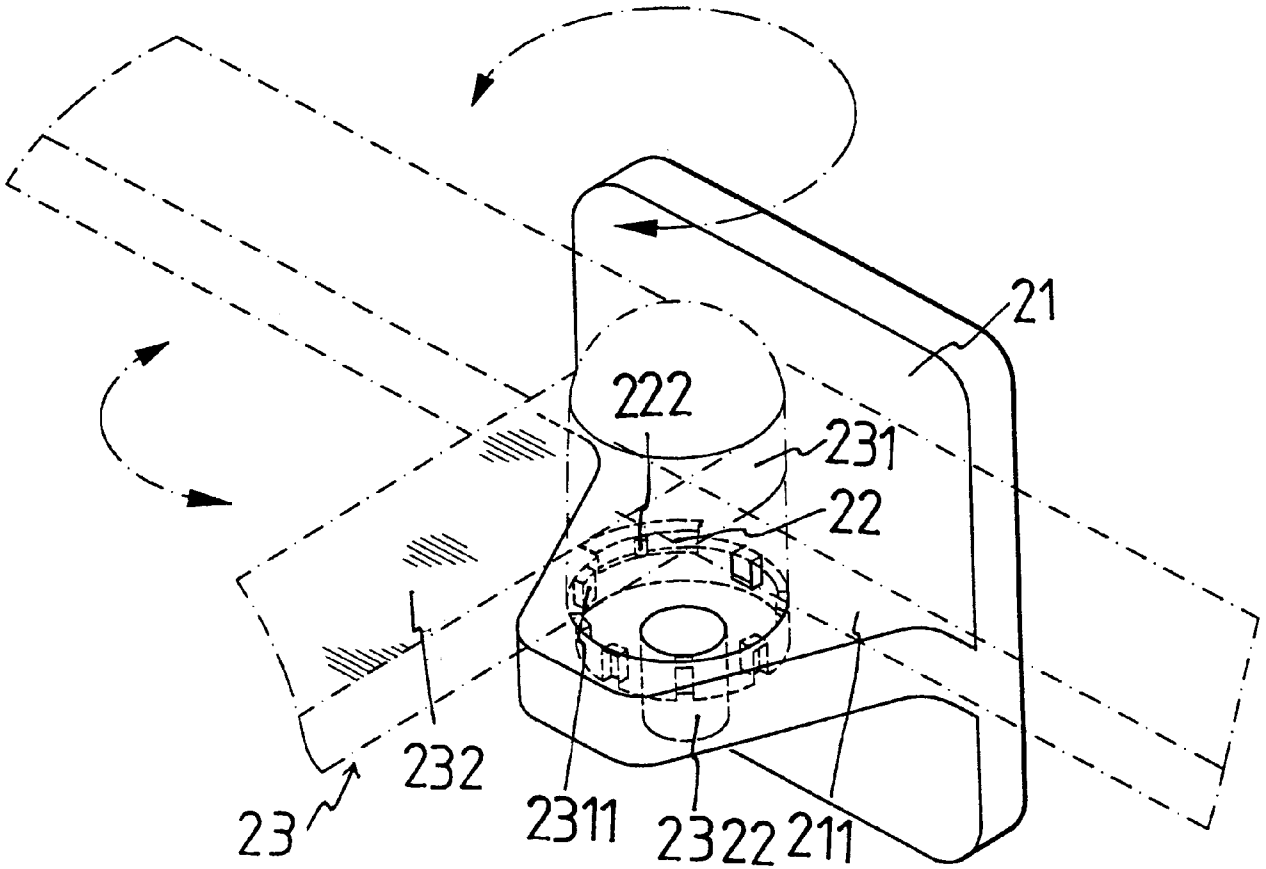
FIG. 2 is a schematic drawing showing the swivel support supported on the mounting frame and turned according to the present invention.

Referring to FIG. 2 and FIGS. 1 and 3 again, the angle adjustable mounting device 2 is comprised of a mounting frame 21, a spring strip 22, and a swivel support 23. The mounting frame 21 is adapted for fastening to for example a monitor of a computer system in a vertical position, comprising a supporting block 211 perpendicularly raised from its front side, a stepped axle hole 213 at the center of the supporting block 211, a smoothly curved groove 212 disposed at the top of the supporting block 211 around the stepped axle hole 213, and two retaining notches 2121 at two opposite ends of the smoothly curved groove 212. The spring strip 22 is mounted within the smoothly curved groove 212, having two hooked ends 221;221' respectively fastened to the retaining notches 2121 of the mounting frame 21, and a raised portion 222 in the middle facing the center of the stepped axle hole 213. The swivel support 23 comprises a horizontal supporting bar 232 and a vertical mounting shaft 231 connected at right angles. The vertical mounting shaft 231 is revolvably supported in the stepped axle hole 213 of the supporting block 211 of the mounting frame 21, having a plurality of locating grooves 2311 equiangularly spaced around the periphery at the bottom and forced into engagement with the raised portion 222 of the spring strip 22, and a downward extending rod 2322 inserted into the smallest diameter of the stepped axle hole 213. When the mounting shaft 231 of the swivel support 23 is turned in the stepped axle hole 213 of the mounting frame 21 to change the angular position of the holder base 1 relative to the monitor, the engagement position between the raised portion 222 of the spring strip 22 and the locating grooves 2311 of the mounting shaft 231 is relatively changed. When the swivel support 23 is released from the hand, it is immediately retained in the adjusted angular position by means of the engagement between the raised portion 222 of the spring strip 22 and the locating grooves 2311 of the mounting shaft 231. The horizontal supporting bar 232 comprises a pivot hole 2320 disposed at one end remote from the mounting shaft 231 and pivotably connected between the pivot holes 120 of the first pair of vertically spaced lugs 12 of the holder base 1 by a pivot pin 5, and two sets of radial grooves 2321 symmetrically disposed at two opposite sides and respectively radially extended from two opposite ends of the pivot hole 2320 and forced into engagement with the ribs 121 of the first pair of vertically spaced lugs 12 of the holder base 1. When the swivel support 23 is turned about the pivot pin 5 by force, the engagement position between the ribs 121 and the radial grooves 2321 is relatively changed. When the swivel support 23 is released from the hand, it is immediately retained in the adjusted angular position by means of the engagement between the ribs 121 and the radial grooves 2321.

Referring to FIGS. 1 and 4 again, the curved holding-down block 3 is pivoted to the second pair of vertically spaced lugs 13 of the holder base 1, and adapted for hold down sheets of document which are turned to the back side of the holder base 1. As illustrated, the curved holding-down block 3 comprises a pivot hole 30 at one end pivotably connected between the pivot holes 130 of the second pair of vertically spaced lugs 13 of the holder base 1 by a pivot pin 5', two sets of radial grooves 31 symmetrically disposed at two opposite sides and respectively radially extended from two opposite ends of the pivot hole 30 and forced into engagement with the ribs 131 of the second pair of vertically spaced lugs 13 of the holder base 1, a stop step 33 at one lateral side thereof in the middle which will be forced into engagement with one side edge of the holder base 1 to limit the forward turning angle of the curved holding-down block 3 when the curved holding-down block 3 is turned away from the back side of the holder base 1 to release turned-up sheets of document, and a smoothly curved end piece 32 adapted for holding down turned-up sheets of document on the back side of the holder base 1.

Referring to FIGS. 1 and 5 again, the clamping devices 4;4' are respectively mounted in the mounting holes 14;14' and roller chambers 15;15' of the holder base 1 for holding down sheets of document. Each clamping device 4 or 4' is comprised of a rack 42 or 42' mounted in the corresponding mounting hole 14 or 14' and having a plurality of transverse teeth 421 or 421', and a toothed roller 41 or 41' turned in the corresponding roller chamber 111 or 111' and having a plurality of longitudinal teeth 411 or 411' equiangularly spaced around the periphery and adapted to engage with the transverse teeth 421 or 421' of the corresponding rack 42 or 42'. The diameter of the toothed rollers 41;41' is slightly bigger than the width of the mouths 15;15'. Therefore, the toothed rollers 41;41' do not fall out of the roller chambers 111;111' through the mouths 15;15' when then are horizontally inserted into the roller chambers 111;111' from one side.

Figure 7:
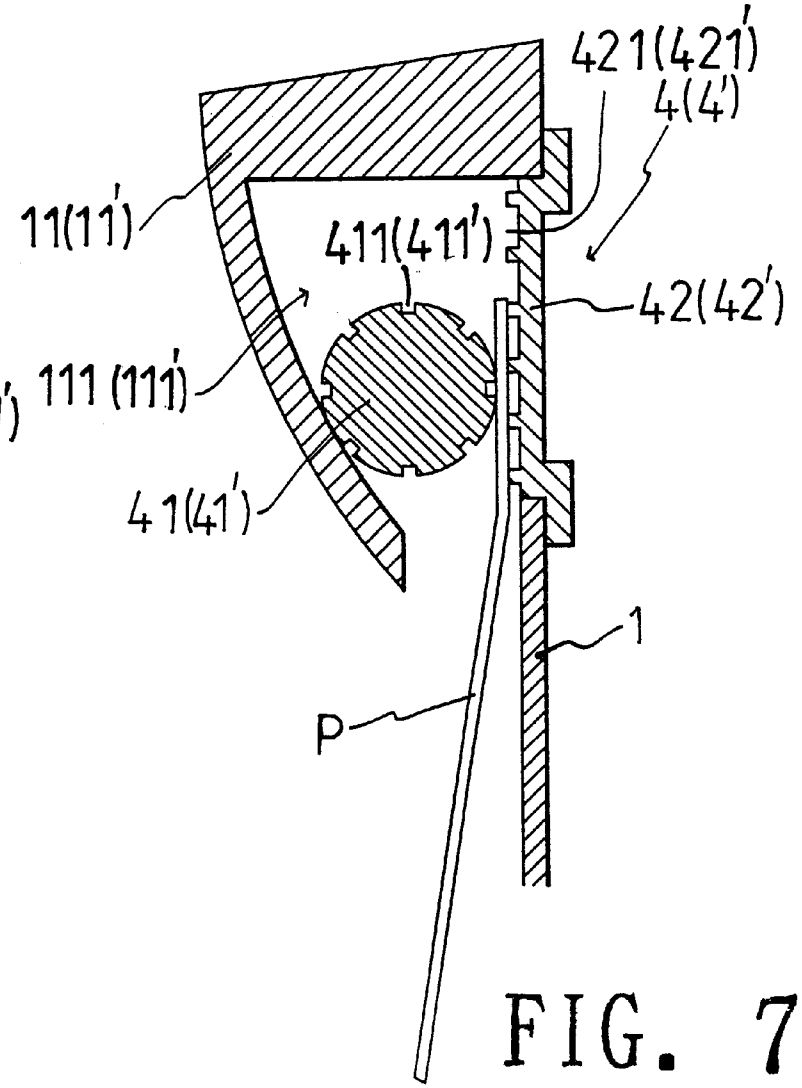
FIG. 7 is similar to FIG. 6 but showing the toothed roller turned downwards inserted sheets of document retained in between the toothed roller and the rack.
Figure 6:
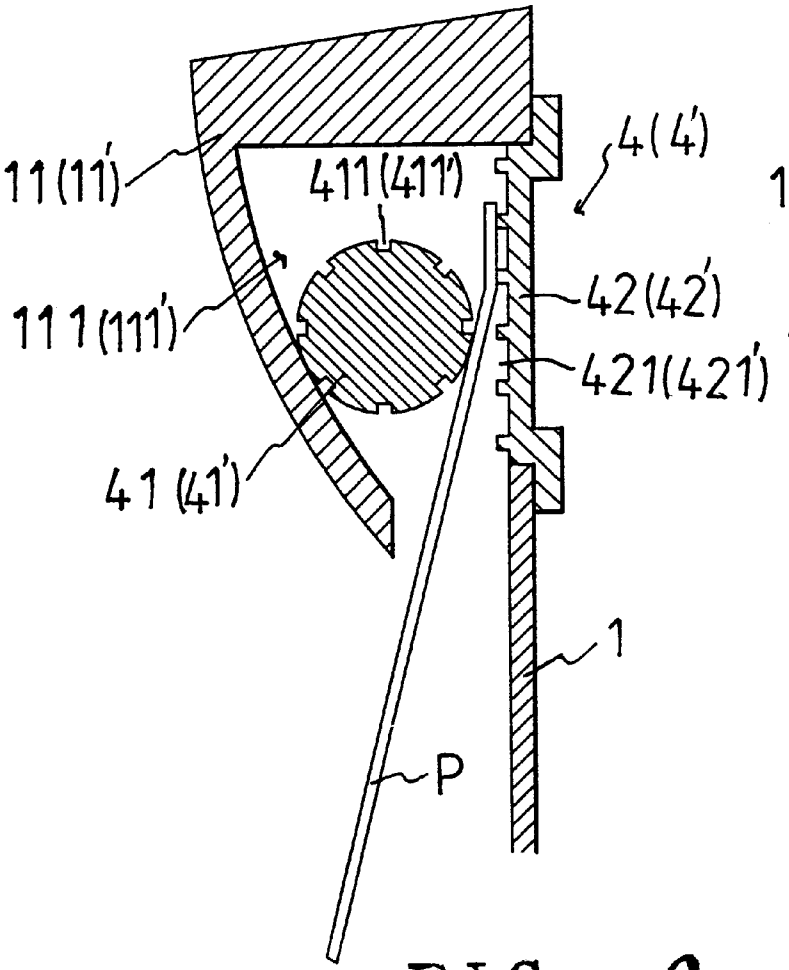
FIG. 6 is similar to FIG. 5 but showing sheets of document inserted into the roller chamber, the toothed roller turned upwards and disengaged from the rack.

Referring to FIGS. 6 and 7, when sheets of document P are inserted through the mouths 15;15' into the roller chambers 111;111', the rollers 41;41' are turned upwards and disengaged from the teeth 421;421' of the racks 42;42' for permitting sheets of document P to pass (see FIG. 6). After the insertion of sheets of document P into the roller chambers 111;111', the rollers 41;41' fall downwards by their gravity weight and are stopped at the mouths 15;15' to hold down inserted sheets of document P.

Figure 8:
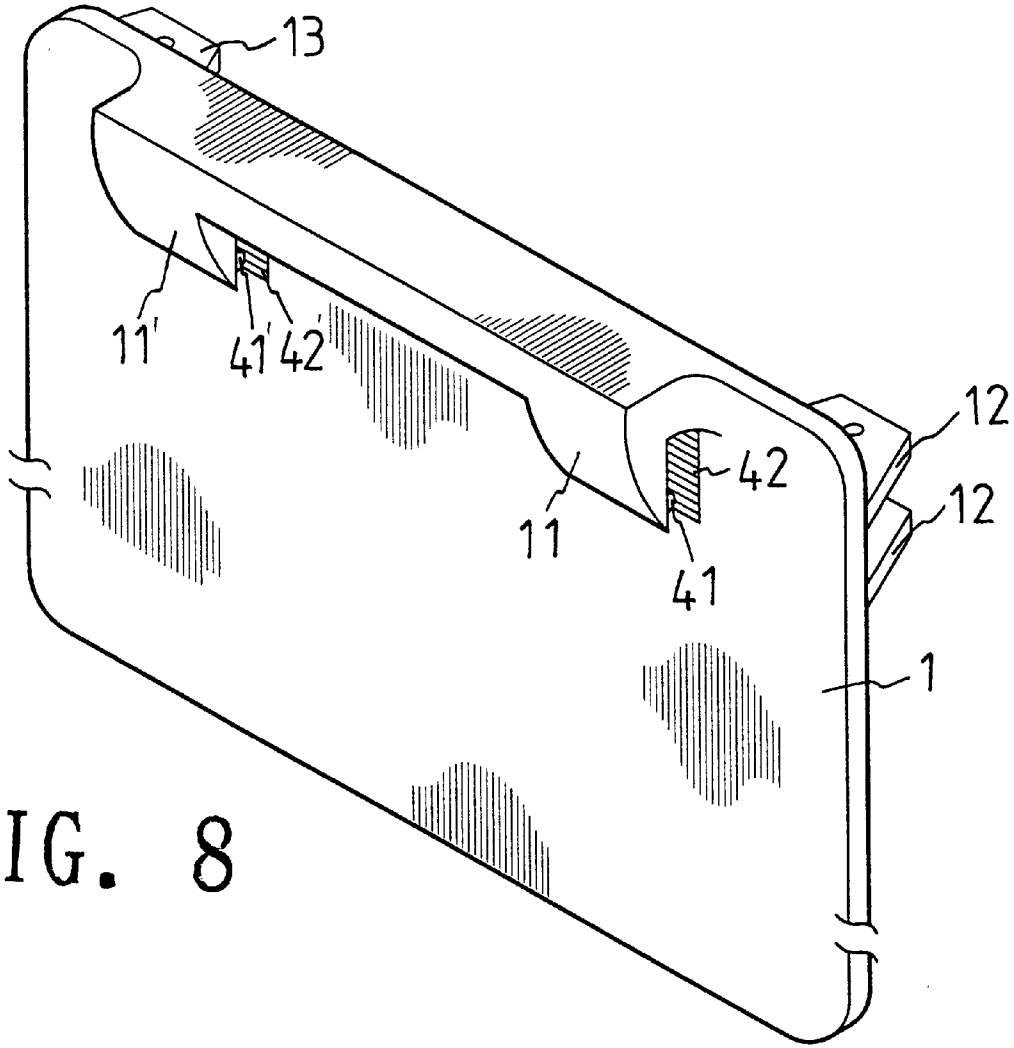
FIG. 8 is an applied view of the present invention showing the direction of removal of sheets of document from the copy holder.

Referring to FIG. 8, by pulling inserted sheets of document P sideways, inserted sheets of document P can be conveniently removed from the copy holder.

Figures 9, 9A:
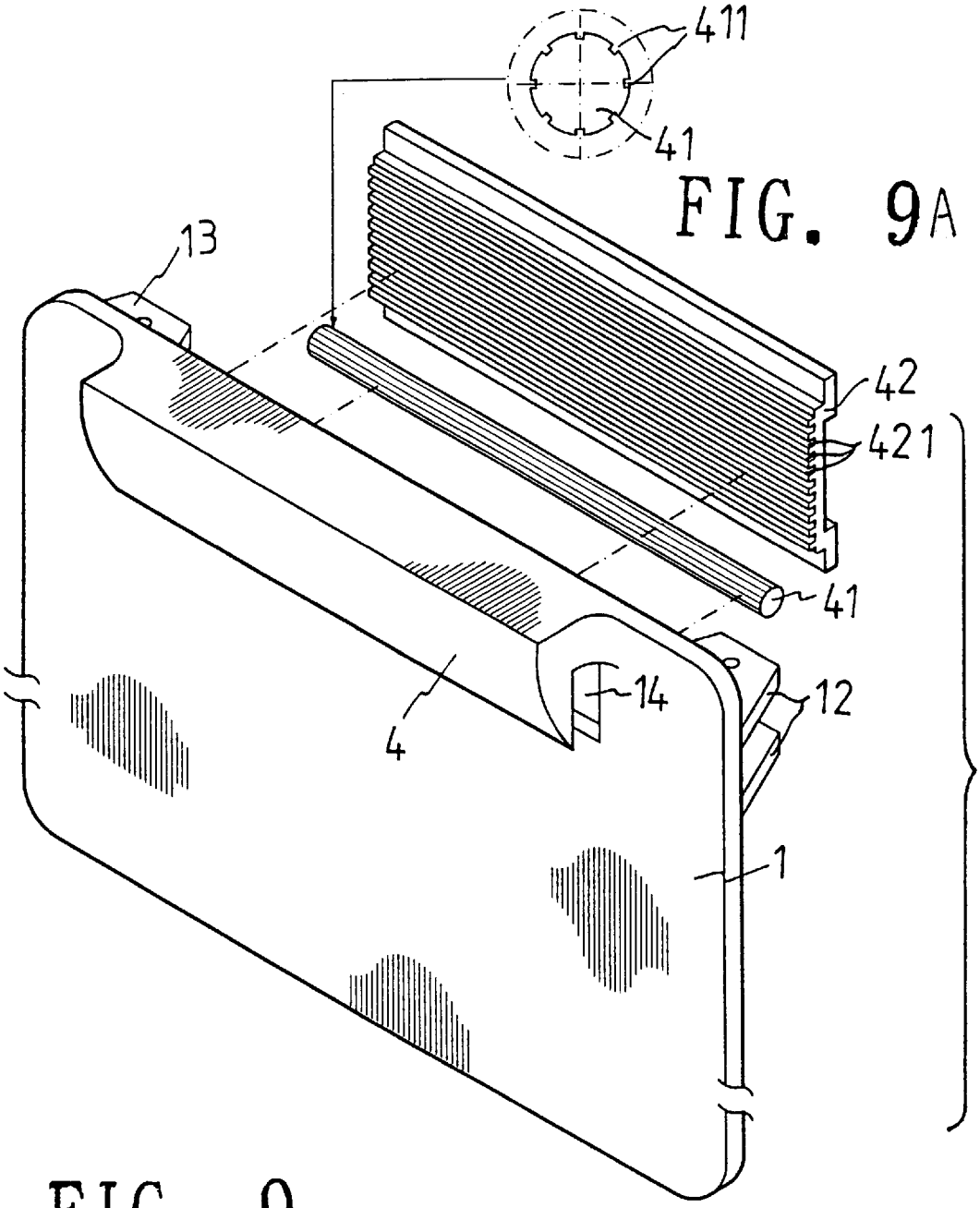
FIG. 9 is an exploded view of a copy holder according to a second embodiment of the present invention.
FIG. 9A is a cross sectional view of the toothed roller according to the second embodiment of the present invention.

FIG. 9 shows an alternate form of the present invention which combines the aforesaid two racks 42;42' into one rack 42 and two toothed rollers 41;41' into one toothed roller 41, and the holder base 1 is made having only one arched flange 11 and one mounting hole 14 for matching with the single piece of rack 42 and the single piece of toothed roller 41.

It is to be understood that the drawings are designed for purposes of illustration only, and are not intended as a definition of the limits and scope of the invention disclosed.

What the invention claimed is:

1. A copy holder comprising:

a flat holder base having at least one arched flange raised from a front side thereof near a top side thereof and defining a document insertion mouth, a first pair of vertically spaced lugs and a second pair of vertically spaced lugs bilaterally raised from a back side thereof;

document clamping means mounted on said flat holder base and adapted to hold down inserted sheets of document in said document insertion mouth;

an angle-adjustable mounting device pivoted to the first pair of vertical lugs of said holder base and adapted for securing to a monitor of a computer system for supporting said flat holder base; and a curved holding-down block pivoted to the second pair of vertically spaced lugs of said holder base and adapted to hold down turned-up sheets of document on the back side of said holder base.

2. The copy holder of claim 1, wherein said at least one arched flange defines with the front side of said holder base at least one roller chamber above said document insertion mouth, said at least one roller chamber having a width gradually upwardly increasing from said document insertion mouth; said document clamping means comprises at least one rack mounted in a respectively hole in said holder base corresponding to said at least one roller chamber, each of said at least one rack having a plurality of transverse teeth, and at least one toothed roller respectively turned in said at least one roller chamber, each of said at least one toothed roller having a plurality of longitudinal teeth equiangularly spaced around the periphery and adapted to engage the transverse tooth of said at least one rack.

3. The copy holder of claim 1, wherein the second pair of vertically spaced lugs of said holder base have a respective pivot hole, and a respective pair of ribs extended from the respective pivot hole at an inner side in reversed directions; said curved holding-down block comprises a pivot hole at one end pivotably connected between the pivot holes of the second pair of vertically spaced lugs of said holder base by a pivot pin, two sets of radial grooves symmetrically disposed at two opposite sides and respectively radially extended from two opposite ends of the pivot hole of said curved holding-down block and forced into engagement with the ribs of the second pair of vertically spaced lugs of said holder base, a stop step at one lateral side thereof in the middle which will be forced into engagement with one side edge of said holder base to limit a forward turning angle of said curved holding-down block when said curved holding-down block is turned away from the back side of said holder base.

4. The copy holder of claim 1, wherein said angle-adjustable mounting device comprises a mounting frame adapted for securing to a monitor of a computer system, a swivel support pivoted to the first pair of vertically spaced lugs of said holder base and revolvably supported on said mounting frame, and a spring strip mounted on said mounting frame and adapted to retain said swivel support in position.

5. The copy holder of claim 4, wherein said mounting frame comprises a supporting block perpendicularly raised from a front side thereof, a stepped axle hole at the center of said supporting block, a smoothly curved groove disposed at a top side of said supporting block around said stepped axle hole, and two retaining notches at two opposite ends of said smoothly curved groove; said spring strip is mounted within the smoothly curved groove of said mounting frame, having two hooked ends respectively fastened to the retaining notches of said mounting frame, and a raised portion in the middle facing the center of said stepped axle hole; said swivel support comprises a horizontal supporting bar and a vertical mounting shaft connected at right angles, said vertical mounting shaft being revolvably supported in the stepped axle hole of said supporting block of said mounting frame, and having a plurality of locating grooves equiangularly spaced around the periphery and forced into engagement with the raised portion of said spring strip.

6. The copy holder of claim 5, wherein the first pair of vertically spaced lugs of said holder base have a respective pivot hole, and a respective pair of ribs extended from the respective pivot hole at an inner side in reversed directions; said horizontal supporting bar of said swivel support comprises a pivot hole at one end pivotably connected between the pivot holes of the first pair of vertically spaced lugs of said holder base by a pivot pin, two sets of radial grooves symmetrically disposed at two opposite sides and respectively radially extended from two opposite ends of the pivot hole of said swivel support and forced into engagement with the ribs of the first pair of vertically spaced lugs of said holder base.

* * * * *